US006390409B1

(12) United States Patent
Högberg

(10) Patent No.: US 6,390,409 B1
(45) Date of Patent: May 21, 2002

(54) ROLL STAND TRANSMISSION DEVICE TO CONTROL WEB TENSION

(75) Inventor: Hans Högberg, Åmål (SE)

(73) Assignee: Megtec Systems Amal AB, Amal (SE)

( * ) Notice: Subject to any disclaimer, the term of this patent is extended or adjusted under 35 U.S.C. 154(b) by 0 days.

(21) Appl. No.: 09/622,927

(22) PCT Filed: Mar. 5, 1999

(86) PCT No.: PCT/SE99/00327

§ 371 Date: Sep. 8, 2000

§ 102(e) Date: Sep. 8, 2000

(87) PCT Pub. No.: WO99/46518

PCT Pub. Date: Sep. 16, 1999

(30) Foreign Application Priority Data

Mar. 9, 1998 (SE) ..... 9800743

(51) Int. Cl.[7] ..... B65H 19/16; F16H 3/10

(52) U.S. Cl. ..... 242/554.5; 242/559.2; 242/554.6; 242/555.7; 242/420.6; 74/810.1

(58) Field of Search ..... 242/554.5, 554.6, 242/555.7, 559.2, 564, 420.4, 559.1, 559; 74/810.1

(56) References Cited

U.S. PATENT DOCUMENTS

| | | | | | |
|---|---|---|---|---|---|
| 1,991,756 | A | * | 2/1935 | Lazich | 74/810.1 |
| 2,505,841 | A | * | 5/1950 | Shuker | 74/810.1 |
| 2,687,658 | A | * | 8/1954 | Nelson | 74/810.1 |
| 3,825,201 | A | * | 7/1974 | Osta | 242/554.3 |
| 3,832,914 | A | | 9/1974 | Pinfield | 74/812 |
| 4,049,095 | A | * | 9/1977 | Montalvo | 192/3.51 |
| 4,256,270 | A | * | 3/1981 | Lee | 242/420.6 |
| 4,501,169 | A | * | 2/1985 | Stilin | 74/810.1 |
| 5,333,517 | A | * | 8/1994 | Bryson | 74/810.1 |
| 5,671,895 | A | * | 9/1997 | Cederholm | 242/420.6 |
| 5,775,630 | A | * | 7/1998 | Hogberg | 242/554.6 |

FOREIGN PATENT DOCUMENTS

| | | | |
|---|---|---|---|
| GB | 2037382 | * | 7/1980 |
| GB | 2 297 364 | | 7/1996 |
| WO | 94/19267 | | 9/1994 |
| WO | 95/08503 | | 3/1995 |

* cited by examiner

*Primary Examiner*—Donald P. Walsh
*Assistant Examiner*—Roberto DiMichele
(74) *Attorney, Agent, or Firm*—Arent Fox Kintner Plotkin & Kahn

(57) ABSTRACT

A roll stand with a frame, a holder arm arranged in the frame, a shaft for the holder, a holder, a motor, and a transmission agent. The transmission agent includes a first and second toothed wheel mounted on an incoming shaft, which is arranged to be driven by the motor, a third toothed wheel and a fifth toothed wheel are arranged on the shaft for the holder, freewheel hubs are arranged at the shaft for the holder between the third and the fifth toothed wheel. The freewheel hubs are capable of locking a toothed wheel in one direction of rotation. Due to the arrangement of the toothed wheels, a first and second drive path is formed so that the transmission agent is capable of achieving two gear changes on an outgoing shaft, depending on the direction of rotation of the motor.

16 Claims, 7 Drawing Sheets

Figure 1:
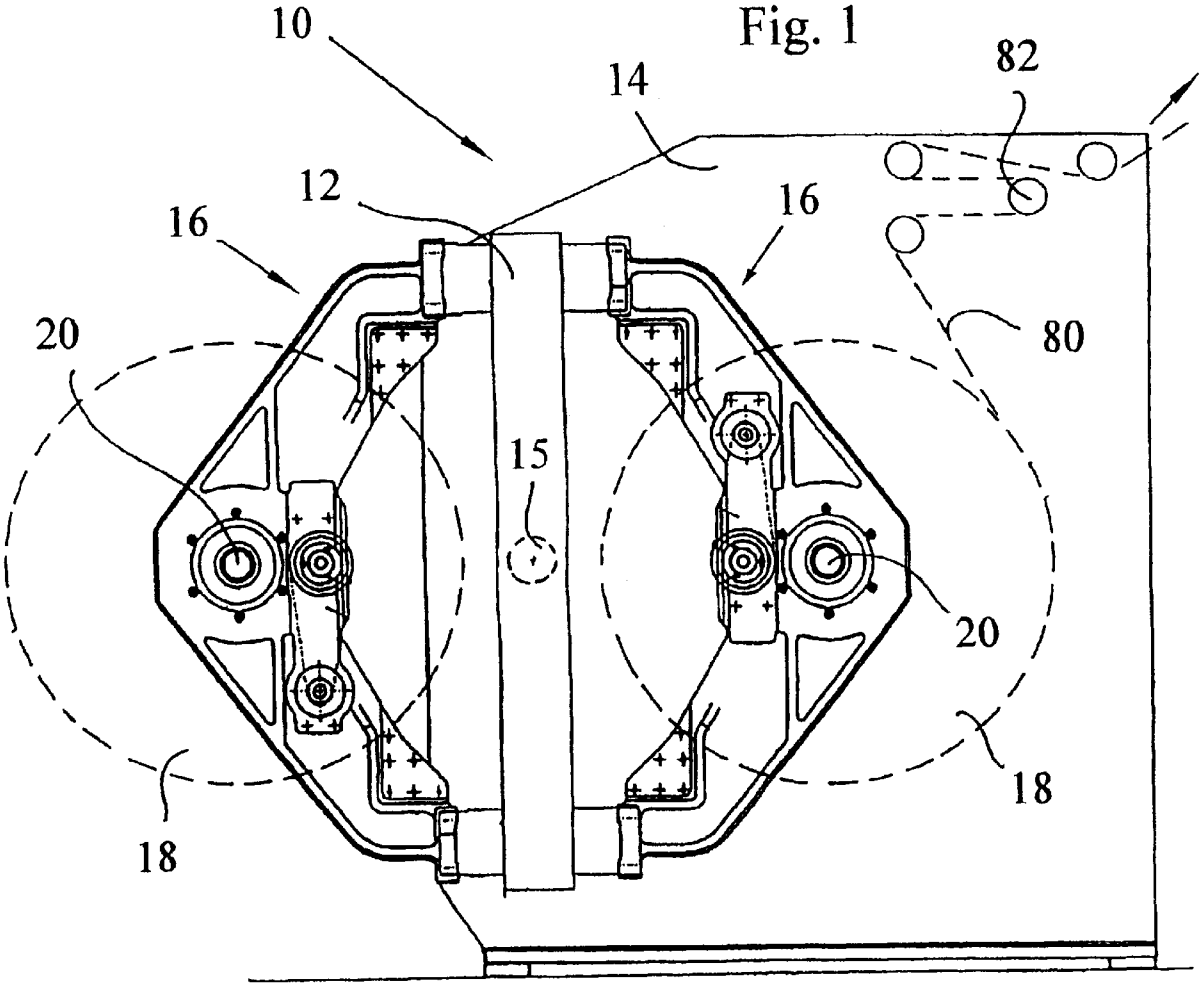

60
52
48
58
54
40
22
46
38
42
26
34
27
20
28
32
30

60
52
48
58
40
54
IX
22
46
38
42
26
34
27
20
28
32
30

ROLL STAND TRANSMISSION DEVICE TO CONTROL WEB TENSION

TECHNICAL FIELD

The present invention relates to a drive assembly comprising an incoming shaft, at least one outgoing shaft, a motor which is connected to said incoming shaft in order to drive said shaft.

BACKGROUND OF THE INVENTION

In machines that use web type of material, for example rotary printing machines, paper is continuously unrolled from paper rolls which are arranged in a roll stand. The roll stand has some type of holder means for at least two paper rolls. The roll stand is most often equipped with some type of drive assembly, in order to, in connection with a roll changing, quickly increase the rotary speed of the new roll, from standstill, to a desired peripherical velocity, which corresponds to the existing web velocity of the paper web of the paper roll which is being unrolled. The roll stand is, moreover, equipped with a brake mechanism, in order to control the web velocity and the web tension. Other devices, such as pendulum rollers, are also arranged to control and adjust the web tension of the paper web.

A large torque is required for large paper rolls, that have a large mass-movement of inertia, in order for the paper roll to reach the desired rotary speed, especially since short times of upstart are desired. Some roll stands are equipped with rollers or a drive belt which drive the periphery of the paper roll. This leads to problems in that the outermost layer is risked to be destroyed. The outermost layer is, moreover, provided with a strip of adhesive tape, which is used to unite the end of a paper web from a previous roll with the beginning of the paper web of a new roll. The adhesive tape can not extend over the entire width of the paper web when drive rollers or drive belts are used, which means that there is Another problem occurs when the paper roll is almost completely unrolled. The rotary speed of the roll will increase dramatically when the diameter is decreased, due to the web velocity and thus the peripherical velocity of the roll being constant. The decrease in mass-moment of inertia of the holder means and a transmission agent arranged with it, and their increase in rotation, creates an increasing requirement of torque. This requirement of torque is partly achieved by the braking moment that creates the pre-set web tension. The web tension will increase when the requirement of torque increases, if no additional contribution is made. In addition to this, the general tendency in modern printing machines is to try to keep the web tension at a relatively low but constant level, in order to get a good print quality, and in order to not risk paper burst or similar. This problem is also accentuated with today's requirements of increasing web velocities. In order to deal with this, there would be needed an additional contribution of torque to the paper roll. The torque which is required in this situation is not as large as at the upstart of a new roll, but there is, on the contrary, a considerably larger number of revolutions needed than at the upstart.

Devices other than roll stands exist, which devices require two different gear changes with the same direction of rotation, depending on different operational conditions.

DESCRIPTION OF THE INVENTION

The object of the present invention is to solve the above problem complex. According to one aspect of the invention, this is achieved with a device according to the preamble, characterized in a transmission agent capable of achieving two gear changes on the outgoing shaft, with the same direction of rotation, depending on the direction of rotation of the motor.

According to one aspect of the invention, it is characterized in that the transmission agent is designed with two drive paths for transmission of the rotation of the motor to the holder means, the two paths being provided with several mechanisms for changing the direction of rotation. The transmission agent may comprise a freewheel hub for each drive path, the freewheel hubs being arranged to lock and thus transmit rotation when the rotation of the corresponding drive path corresponds to the direction of rotation of the outgoing shaft, and also to disconnect when the rotation does not correspond to the direction of rotation of the outgoing shaft.

Thanks to the design according the present invention, several advantages are attained. Depending on the operation conditions, there can either be applied a relatively large torque. For example, at the upstart of a device with a large mass-moment of inertia connected to the outgoing shaft without requiring the rotary speed to be so high, or a relatively high rotary speed can be transmitted from the motor to the outgoing shaft. For example during continuous operation or at additional contribution of power, which is required at the unrolling of paper from a roll stand when the roll is almost completely unrolled. Moreover, the device permits free rotation of the outgoing shaft when the motor not is driving the incoming shaft.

Thanks to the design with a transmission agent with two alternative drive paths, there is a possibility either to transmit a large torque at a low number of revolutions, or a small torque at a high number of revolutions, with one and the same motor.

The transmission via the two different drive paths is moreover easily achieved, when different numbers of means for changing the direction of rotation and also a freewheel hub is used, simply by changing the direction of rotation of the motor.

These and other aspects of, and advantages with, the present invention will be apparent from the detailed description of a preferred embodiment, and from the enclosed claims.

SHORT DESCRIPTION OF THE FIGURES

Figure 2:
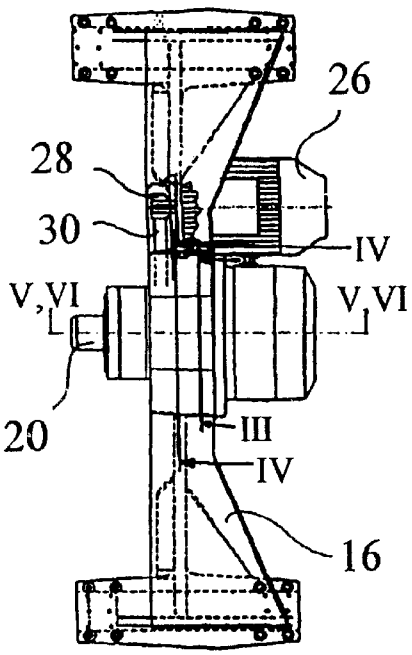
Figure 3:
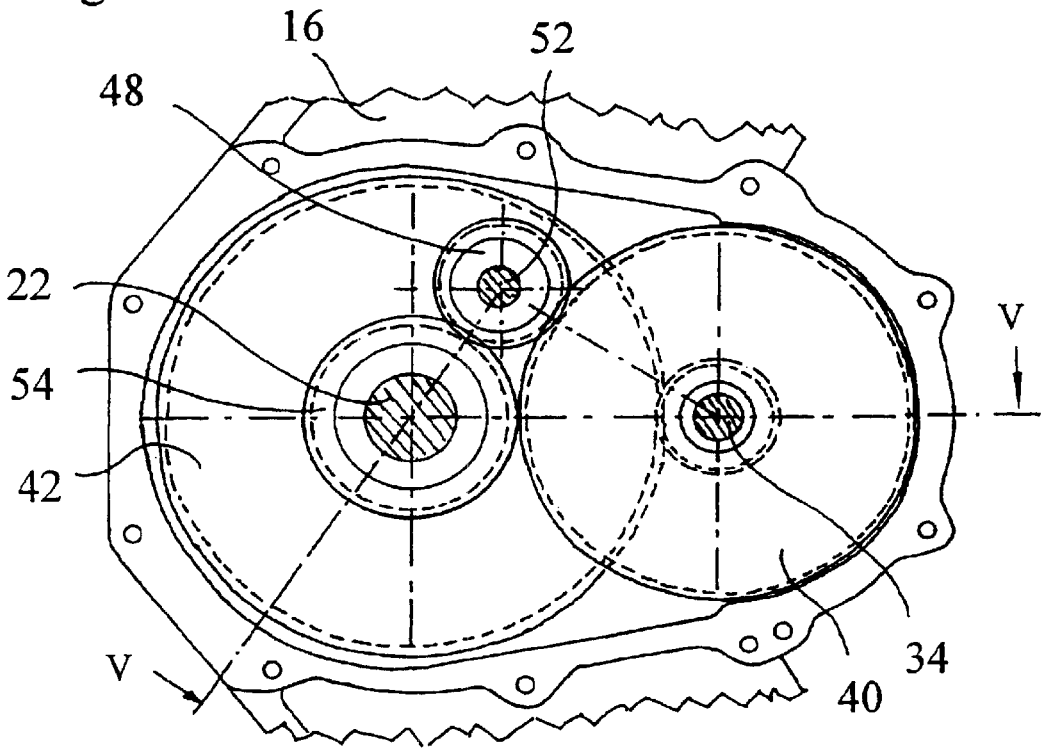
Figure 4:
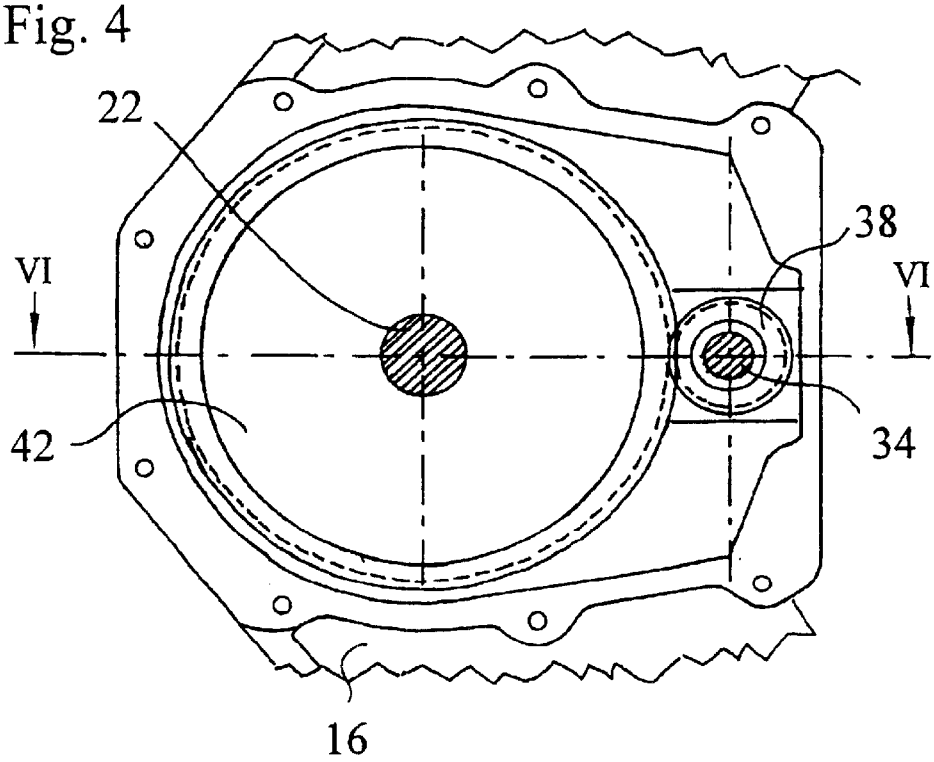
Figure 5:
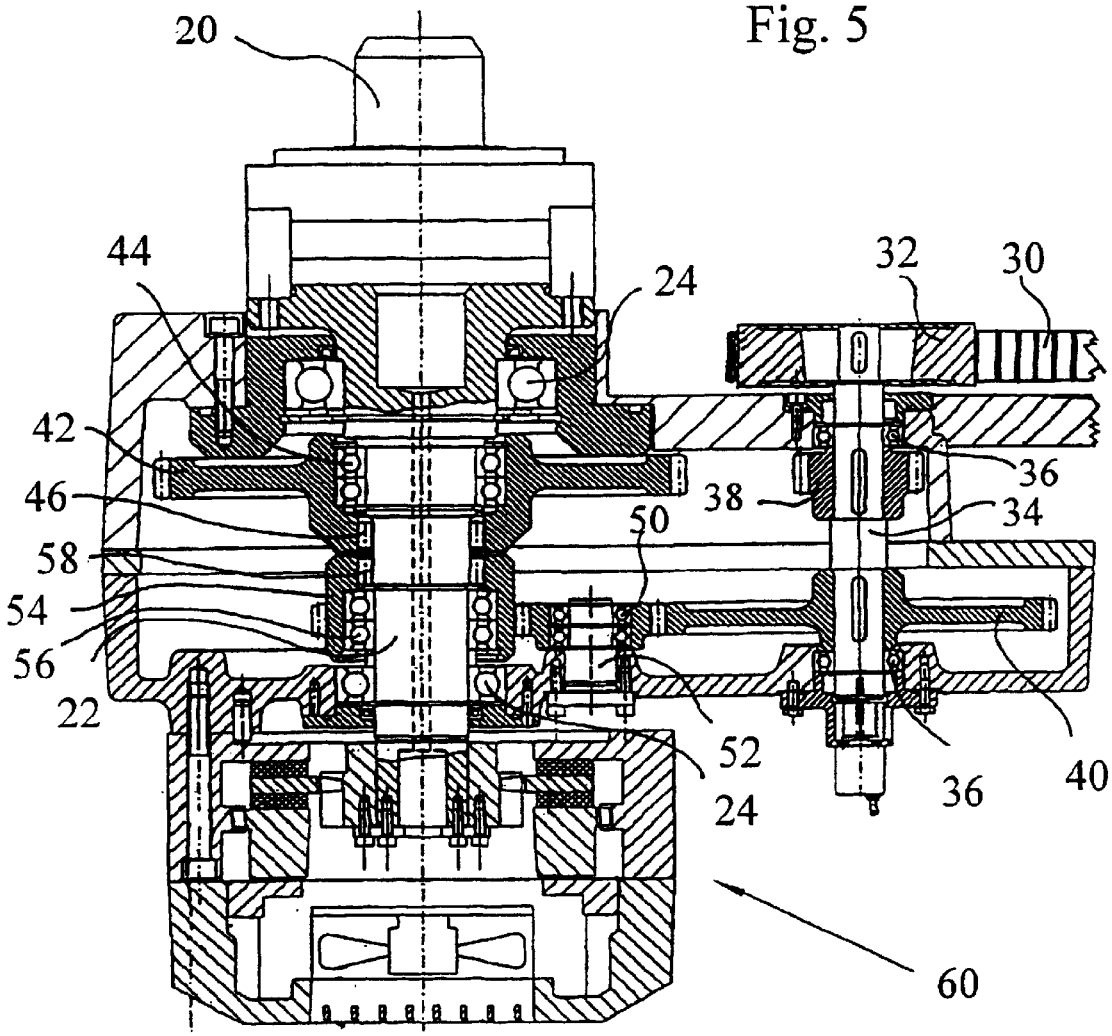
Figure 6:
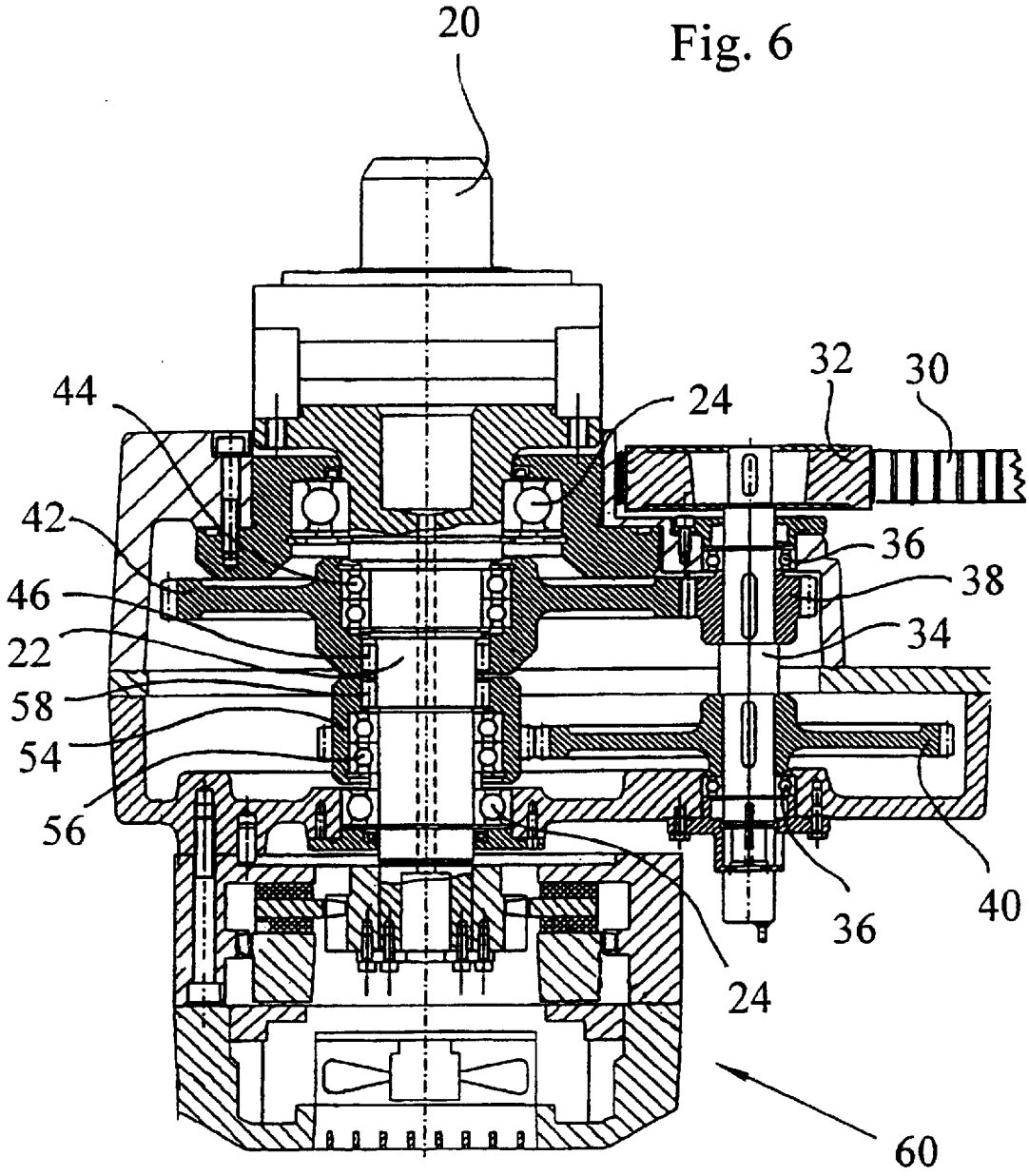
Figure 7:
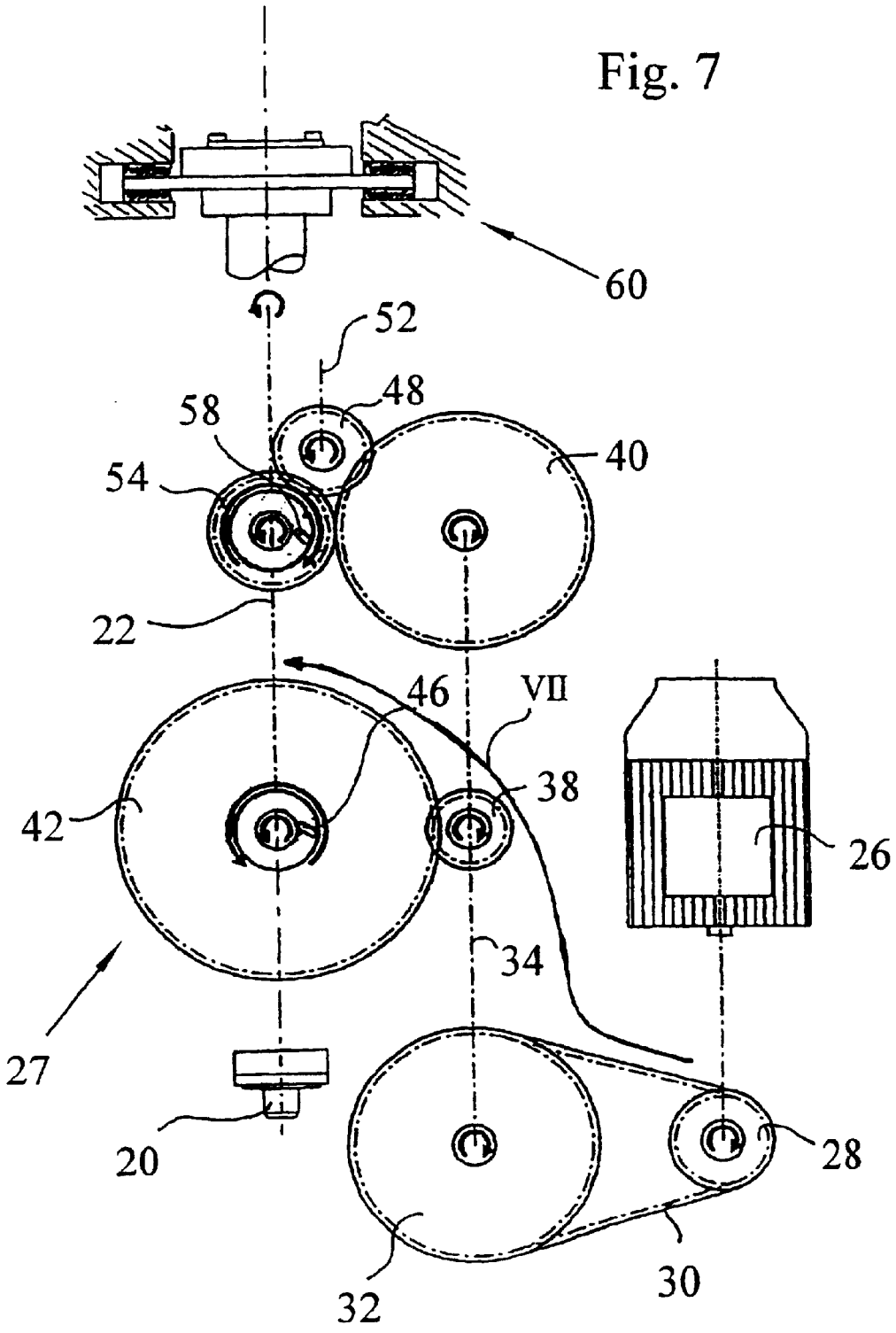
Figure 8:
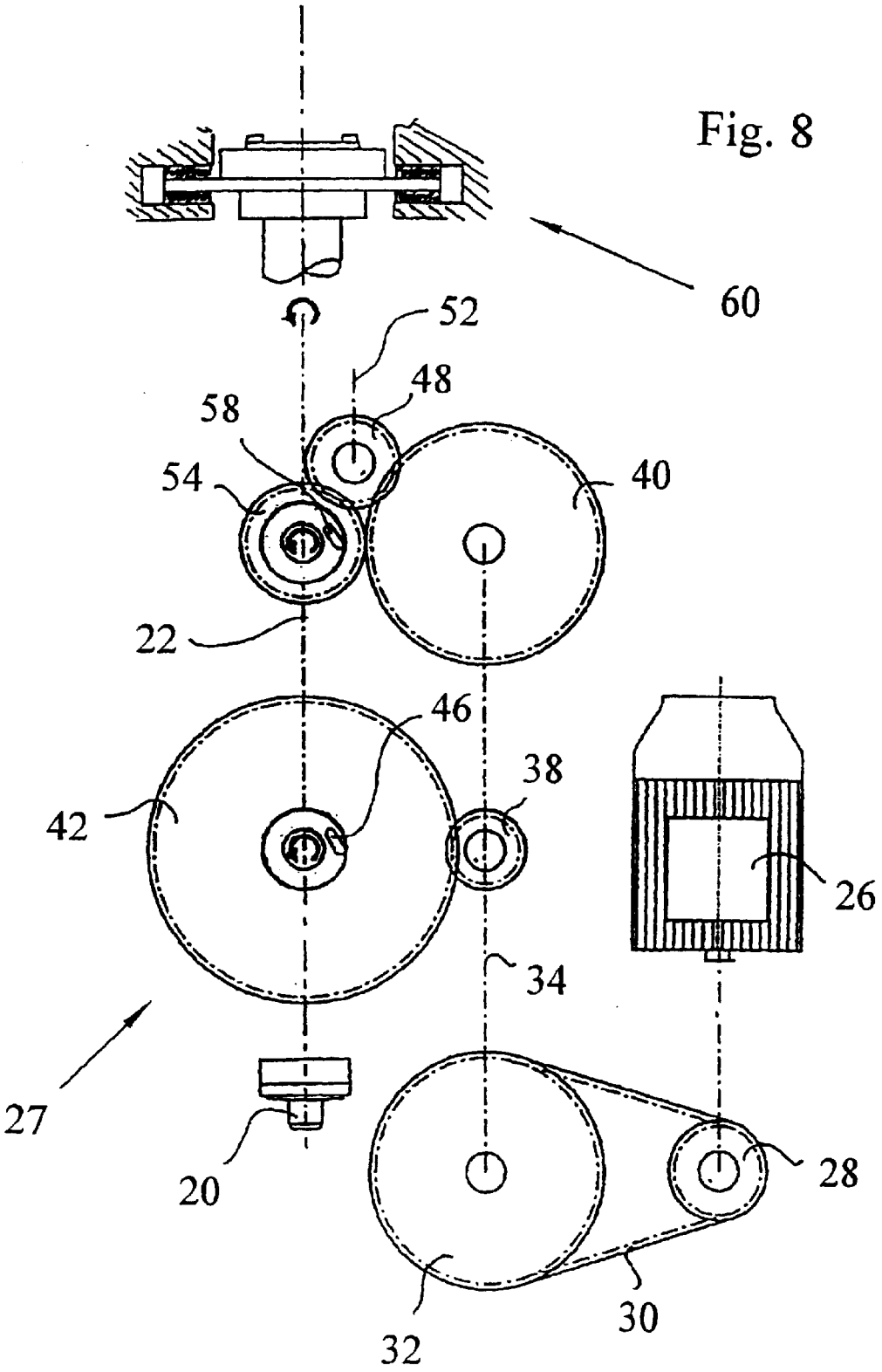
Figure 9:
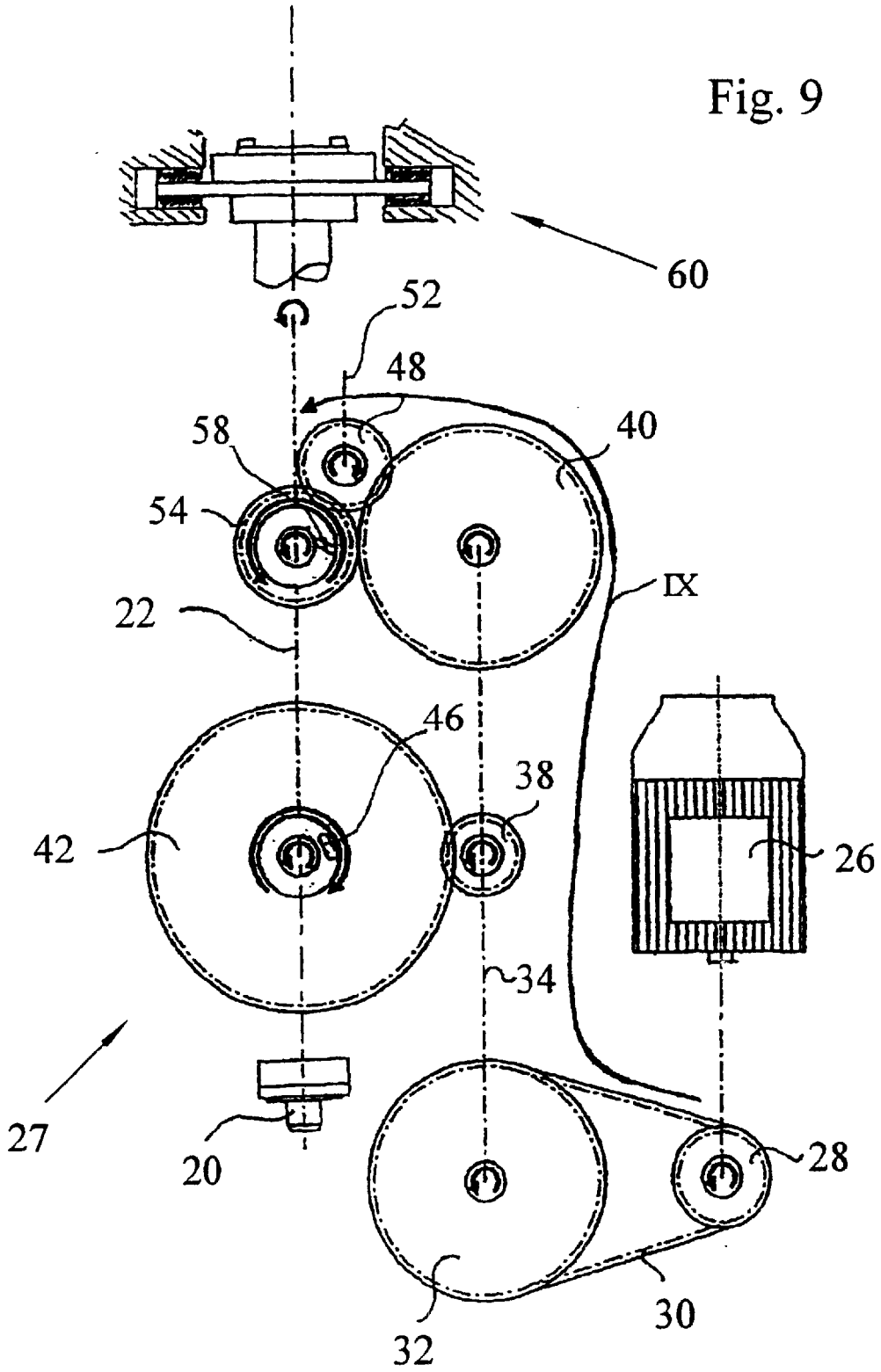

In the following description of a preferred embodiment there will be referred to the enclosed drawings, of which:

FIG. 1 is showing a side view, partly in cross section, of a roll stand with holder arms for the rolls, on which arms the present invention is arranged, FIG. 2 is showing a holder arm for the rolls, which arm is rotated 90° in relation to FIG. 1, FIG. 3 is showing a detailed view along the line III—III in FIG. 2, FIG. 4 is showing a detailed view along the line IV—IV in FIG. 2, FIG. 5 is showing a detailed view, in cross section, along the line V—V in FIG. 3, FIG. 6 is showing a detailed view, in cross section, along the line VI—VI in FIG. 4, FIG. 7 is schematically showing the function of the device according to the invention, at the upstart of a new paper roll, FIG. 8 is schematically showing the function of the device at continuous unrolling of a paper roll, and FIG. 9 is schematically showing the function of the device in connection with small diameters and thereby a high rotary speed in a paper roll.

DESCRIPTION OF A PREFERRED EMBODIMENT

The roll stand, in connection with which the present invention is used, is in FIG. 1 generally denoted with the reference numeral 10. The roll stand comprises, in the shown embodiment, a frame 12 which is rotatably journalled in bearings in two gables 14, one of them being shown in FIG. 1, so that it may be rotated about a horizontal shaft 15. A couple of holder arms 16 for the roll is arranged on each side of the frame. These may preferably be displaced on the frame in the horizontal direction. Paper rolls 18 are arranged between each pair of holder arms for the rolls. The holder arms 16 for the rolls comprise holder means 20, mounted on shafts 22, hereinafter denoted shafts for holder means, which shafts are rotatably journalled in bearings 24. The holder means are, in the shown embodiment, designed as chucks intended to be engaged with the ends of cores, on which cores the paper rolls are rolled. A motor 26 is arranged on one of the holder arms for the rolls in each pair, FIG. 2.

The roll stand is equipped with a transmission agent 27 between the motor and the shaft for holder means. The components which are part of the transmission agent, will be described in the following. A belt wheel 28, and a thereto arranged toothed belt 30, is mounted on the outgoing motor shaft. The toothed belt runs about a second belt wheel 32, which is mounted on the end of a shaft 34, FIG. 5 and 6, hereinafter denoted incoming shaft, which incoming shaft is arranged in the vicinity of the shaft 22 for holder means, and parallel therewith. The incoming shaft 34 is rotatably journalled in bearings 36.

A first toothed wheel 38 is arranged on the incoming shaft 34, closest to the end with the belt wheel of the shaft, as well as a second toothed wheel 40, a distance from the end of the shaft. The first toothed wheel 38 is engaged with a third toothed wheel 42, FIG. 4. The third toothed wheel 42 is rotatably mounted on the shaft 22 for holder means, by air of bearings 44. Between the third toothed wheel and the shaft for holder means, there is arranged a freewheel hub 46, which freewheel hub locks the third toothed wheel to the shaft 22 for holder means, when the toothed wheel is rotated with the same direction of rotation as the direction of rotation of the shaft for holder means at normal unrolling, and disengages the third toothed wheel when this is rotated with the opposite direction of rotation or is standing still. The first toothed wheel 38 has a diameter which is considerably less than the diameter of the third toothed wheel 42, so that a lower gear ratio is obtained.

The second toothed wheel 40 on the incoming shaft 34 is engaged with the fourth toothed wheel 38, FIG. 3 and 5. The fourth toothed wheel is rotatably journalled in bearings 50 on a shaft 52, hereinafter denoted as the intermediate shaft. The fourth toothed wheel 48 is, in its turn, engaged with a fifth toothed wheel 54. The fifth toothed wheel 54 is rotatably journalled in bearings 56 on the shaft 22 for holder means. A freewheel hub 58 is arranged between the fifth toothed wheel and the shaft for holder means. The freewheel hub operates to lock the fifth toothed wheel to the shaft 22 for holder means. When the toothed wheel is rotated in the same direction of rotation as the direction of rotation of the shaft for holder means, for example, when paper is being unrolled from the paper roll the freewheel hub is locked. When the toothed wheel is rotated in the opposite direction of rotation, or stands still, the freewheel hub is unlocked or disengaged from the fifth toothed wheel. The second toothed wheel 40 has a diameter which is considerably larger than the diameter of the fourth toothed wheel 48, and the fourth and fifth toothed wheels have about the same diameter, so that a higher gear ratio is obtained. The entire transmission agent is preferably arranged in a protective casing.

A brake 60 of a conventional type, which will not be described in any further detail, is arranged on the shaft 22 for holder means, in the opposite end of the holder means 20. The device also comprises control and regulation means, and a transmitter for control and regulation of the motor, the brake, the number of revolutions of the paper rolls, the web tension and the alike, not shown.

The device is intended to operate according to the following. Paper rolls 18 are mounted between the holder arms 16 for rolls, the holder means 20 engaging in the center of the rolls. The paper web 80, for the roll which is to be unrolled, the right roll in FIG. 1, is led via different guide and tension controlling rollers 82, to the next machine for treatment, whereby the roll is rotating anti-clockwise in the figures. Since the roll is heavy in the beginning and thus has a large mass-moment of inertia, it will need help in order to quickly be accelerated to the desired web velocity, at the upstart of the first shift, or especially at the changing of rolls, in order for the new roll to quickly reach the same peripherical velocity as the web velocity. FIG. 7 is showing how the device according to the invention functions in connection with the acceleration of the paper roll.

The motor 26 is thereby provided with a voltage, to make it rotate in a certain direction, clockwise in FIG. 7. The rotation is transmitted to the incoming shaft 34 via the belt transmission 28–32, which has a certain gear change, so that the incoming shaft rotates more slowly than the motor. The rotation of the incoming shaft makes the first 38 and second 40 toothed wheels rotate. The rotation of the first toothed wheel 38 is transmitted to the third toothed wheel 42 on the shaft 22 for holder means. Due to the third toothed wheel 42 having the same direction of rotation as the shaft for holder means shall have for unrolling, the freewheel hub 46 locks and a firm coupling is achieved. The rotation of the second toothed wheel 40 is transmitted via the fourth toothed wheel 48 to the fifth toothed wheel 54, which will rotate in the opposite direction in relation to the shaft 22 for holder means, whereby this freewheel hub 58 will be disengaged, and accordingly not will affect the rotation of the shaft for holder means.

The torque from the motor will accordingly be transmitted to the shaft for holder means along the drive path which is indicated with the arrow VII. Thanks to the diameter of the first toothed wheel 38 being considerably smaller than the diameter of the third toothed wheel 42, there is achieved a lower gear change for the rotary speed and at the same time an increase of the torque on the shaft 22 for holder means and thereby the paper roll in relation to the motor. A high torque is required in order to overcome the mass-moment of inertia of the roll and to quickly increase the rotation of the roll, at the same time as the rotary speed not having to be especially high for a given web velocity.

The change of paper rolls takes place, when the roll has been accelerated to the correct rotary speed by the motor and the transmission, by the end of the new roll being attached to the paper web of the unrolled roll. The continued unrolling is then taken care of by the paper web being pulled by the next machine and the web tension being controlled by the brake. Now, the motor is switched off, FIG. 8. Both of the freewheel hubs 46, 58 are disengaged, in this situation, by the shaft for holder means rotating faster than the toothed wheels and the shaft 22 for holder means rotating freely. The rotary speed of the roll and the web tension is controlled continuously and adjusted via the brake 60.

A contribution of torque may be required when the diameter of the roll decreases. A considerable acceleration takes place due to the diameter of the roll decreasing considerably at the end of the unrolling of a paper roll while the web velocity, and thus, the peripherical velocity, of the roll being constant. This acceleration results, in combination with the mass-moment inertia of holder means, transmissions and brake, in an increased power requirement in order to be able to unroll the paper without the web tensions becoming to high, which web tension can not, in practice, be increased to an unlimited extent. In this situation, there is provided a voltage to the motor 26, to make it rotation in the opposite direction to the direction in connection with the acceleration of the roll, in the shown case anti-clockwise in FIG. 9. As before, the rotation is transmitted to the incoming shaft 22 and to the first 38 and second 40 toothed wheels. The freewheel hub 46, between the third toothed wheel 42 and the shaft 22 for holder means, will not disengage, due to the direction of rotation being the opposite, while the freewheel hub 58, between the fifth toothed wheel 54 and the shaft 22 for holder means, is engaged. Accordingly, the power is now transmitted from the motor along the drive path which is indicated by the arrow IX. Thanks to the second toothed wheel 40 having a considerably larger diameter than the fourth toothed wheel 48, the fourth and fifth toothed wheels having approximately the same diameter, there is achieved a lower gear change for the rotary speed.

Since the diameter of the roll is relatively small, and the web velocity is constant, there is required a high rotary speed in this situation. The torque which is transmitted from the motor becomes relatively low for this gear change, but does not need to be very large in this situation.

It is to be understood that the invention is not limited to the above described and the embodiment shown in the figures, but can be modified within the scope of the following claims.

Accordingly, there may be used other devices in the transmission agent, such as a drive belt and similar. It should also be understood that there may be used other holder means than the above described.

What is claimed is:

1. A roll stand, comprising:

a frame;

at least one holder arm for a roll, which arm is arranged in the frame;

a shaft for holder means, which shaft is arranged in the frame;

a holder means, arranged at one end of the shaft for holder means;

a motor; and a transmission agent between the motor and the shaft for holder means, wherein the transmission agent comprises:

a first toothed wheel and a second toothed wheel, being fixedly mounted on an incoming shaft, which is arranged to be driven by said motor, a third toothed wheel and a fifth toothed wheel, arranged on said shaft for holder means, freewheel hubs, arranged at the shaft for holder means between the third and the fifth toothed wheel, respectively, and the shaft for holder means, which freewheel hubs are capable of locking the corresponding toothed wheel in one direction of rotation each; and a fourth toothed wheel, arranged in an intermediate shaft, the first toothed wheel being in direct engagement with the third toothed wheel, forming a first drive path, and where the second toothed wheel, via the fourth toothed wheel is engaged with the fifth toothed wheel, forming a second drive path, so that the transmission agent is capable of achieving two gear changes on an outgoing shaft, with the same direction of rotation, depending on the direction of rotation of the motor.

2. The roll stand according to claim 1, wherein the transmission agent also comprises a rotary transmission in order to transmit a rotary movement from the motor to the incoming shaft.

3. The roll stand according to claim 2, wherein the transmission is of a belt type drive.

4. The roll stand according to claim 1, wherein the diameters of the first and third toothed wheels are chosen to give a gear reduction in relation to the number of revolutions of the motor, and the diameters of the second, fourth and fifth toothed wheels to give a gear step-up in relation to the number of revolutions of the motor, in that the rotation of the motor, when the motor rotates in a certain direction of rotation, is transmitted over the first drive path, whereby the freewheel hub for this drive path locks and thereby transmits rotation to the shaft for holder means, and whereby the freewheel hub for the second drive path is disengaged, and in that the rotation of the motor, when the motor rotates in the opposite direction, is transmitted over the second drive path, whereby the freewheel hub for this drive path locks and thereby transmits rotation to the outgoing shaft, and whereby the freewheel hub for the first drive path is disengaged.

5. The roll stand according to claim 1, wherein the second toothed wheel of the transmission agent has a diameter which is considerably larger than the diameter of the fourth toothed wheel.

6. The roll stand according to claim 5, wherein the fourth and fifth toothed wheels of the transmission agent have approximately the same diameter, so that a high gear ratio is obtained.

7. The roll stand according to claim 1, wherein the transmission agent is arranged in a protective casing.

8. The roll stand according to claim 1, wherein the freewheel hubs of the transmission agent are arranged directly next to each other on the shaft for holder means.

9. The roll stand according to claim 8, wherein the freewheel hubs of the transmission agent are arranged directly next to each other on the shaft for holder means, in the vicinity of the center point of the shaft for holder means.

10. A transmission agent for use in a roll stand, the roll stand having a frame, a holder arm for a roll, a shaft for holder means and a motor, wherein the transmission agent comprises:

a first toothed wheel and a second toothed wheel, being fixedly mounted on an incoming shaft, which is arranged to be driven by said motor;

a third toothed wheel and a fifth toothed wheel, arranged on said shaft for holder means;

freewheel hubs, arranged at the shaft for holder means between the third and the fifth toothed wheel, respectively, and the shaft for holder means, which freewheel hubs are capable of locking the corresponding toothed wheel in one direction of rotation each; and a fourth toothed wheel, arranged in an intermediate shaft, the first toothed wheel being in direct engagement with the third toothed wheel, forming a first drive path, and where the second toothed wheel, via the fourth toothed wheel is engaged with the fifth toothed wheel, forming a second drive path, so that the transmission agent is capable of achieving two gear changes on an outgoing shaft, with the same direction of rotation, depending on the direction of rotation of the motor.

11. The transmission agent according to claim 10, wherein the transmission agent also comprising a transmission of a belt type drive, in order to transmit a rotary movement from the motor to the incoming shaft.

12. The transmission agent according to claim 11, wherein the fourth and fifth toothed wheels of the transmission agent have approximately the same diameter, so that a high gear ratio is obtained.

13. The transmission agent according to claim 10, wherein the diameters of the first and third toothed wheels are chosen to give a gear reduction in relation to the number of revolutions of the motor, and the diameters of the second, fourth and fifth toothed wheels to give a gear step-up in relation to the number of revolutions of the motor, in that the rotation of the motor, when the motor rotates in a certain direction of rotation, is transmitted over the first drive path, whereby the freewheel hub for this drive path locks and thereby transmits rotation to the shaft for holder means, and whereby the freewheel hub for the second drive path is disengaged, and in that the rotation of the motor, when the motor rotates in the opposite direction, is transmitted over the second drive path, whereby the freewheel hub for this drive path locks and thereby transmits rotation to the outgoing shaft, and whereby the freewheel hub for the first drive path is disengaged.

14. The transmission agent according to claim 10, wherein the second toothed wheel of the transmission agent has a diameter which is considerably larger than the diameter of the fourth toothed wheel.

15. The transmission agent according to claim 10, wherein the transmission agent is arranged in a protective casing.

16. The transmission agent according to claim 10, wherein the freewheel hubs of the transmission agent are arranged directly next to each other on the shaft for holder means, in the vicinity of the center point of the shaft for holder means.

* * * * *